US007422164B2

(12) United States Patent
Matsumoto

(10) Patent No.: US 7,422,164 B2
(45) Date of Patent: Sep. 9, 2008

(54) SPRAY GUN WITH PRESSURE DISPLAY

(75) Inventor: Takuya Matsumoto, Yokohama (JP)

(73) Assignee: Anest Iwata Corporation, Kanagawa-ken (JP)

( * ) Notice: Subject to any disclaimer, the term of this patent is extended or adjusted under 35 U.S.C. 154(b) by 262 days.

(21) Appl. No.: 10/501,458

(22) PCT Filed: Jan. 17, 2003

(86) PCT No.: PCT/JP03/00344

§ 371 (c)(1),
(2), (4) Date: Feb. 2, 2005

(87) PCT Pub. No.: WO03/061842

PCT Pub. Date: Jul. 31, 2003

(65) Prior Publication Data

US 2005/0127201 A1 Jun. 16, 2005

(30) Foreign Application Priority Data

Jan. 18, 2002 (JP) ..... 2002-009528

(51) Int. Cl.
*B05B 9/00* (2006.01)

(52) U.S. Cl. ..... 239/526; 239/525; 239/290; 73/756; 73/716

(58) Field of Classification Search ..... 239/74, 239/290, 525, 526, 71; 73/716, 756; 137/557; 451/90
See application file for complete search history.

(56) References Cited

U.S. PATENT DOCUMENTS 2,780,496 A * 2/1957 Asbeck et al. ..... 239/290
3,482,781 A * 12/1969 Sharpe ..... 239/71
4,628,644 A * 12/1986 Somers ..... 451/90
4,809,909 A * 3/1989 Kukesh ..... 239/1
5,191,797 A * 3/1993 Smith ..... 73/714
5,713,519 A 2/1998 Sandison et al.
6,585,173 B2 * 7/2003 Schmon et al. ..... 239/526
7,017,838 B2 * 3/2006 Schmon ..... 239/526

FOREIGN PATENT DOCUMENTS

DE 10031857 * 1/2002
JP 5-22277 6/1993
JP 11-201849 7/1999

(Continued)

*Primary Examiner*—Frederick C. Nicolas
*Assistant Examiner*—Trevor E. McGraw
(74) *Attorney, Agent, or Firm*—Wenderoth, Lind & Ponack, L.L.P.

(57) ABSTRACT

A spray gun with pressure display for applying paint onto a painted object by atomizing the paint with compressed air. A pressure indicating device includes a digitally displayed pressure sensor (25), a pressure transducer part (24), and a display part (27) unitized with each other. The pressure indicating device is detachably installed on a spray gun body, and adapters (21, 22) without a pressure indication function are detachably fitted to the spray gun body according to the shape of the body grip part so that the presence or absence of the pressure indication function can be selected before use. The spray gun can be used under controlled conditions by allowing a worker to detect an air pressure at hand during spraying operation since the spraying air pressure largely affects paint finish as well as dispersion of atomized paint.

6 Claims, 4 Drawing Sheets

FOREIGN PATENT DOCUMENTS

| | | |
|---|---|---|
| JP | 2000-214039 | 8/2000 |
| JP | 2001-208634 | 8/2001 |
| JP | 2003-88780 | 3/2003 |
| WO | 91/16610 | 10/1991 |
| WO | 97/03758 | 2/1997 |

* cited by examiner 7
8
16
15
10
27
14
9

7
12
21
11
14

7
12
22

SPRAY GUN WITH PRESSURE DISPLAY

BACKGROUND OF THE INVENTION

1. Technical Field

The present invention relates to a spray gun usable with a module including a removable, easy-to-view, high-accuracy digital pressure gauge being installed in the spray gun as necessary.

2. Description of Related Art

The air spray gun uses compressed air to atomize a paint for spraying an object to be coated. To assure a stable quality of painting with the spray gun, it is necessary to always monitor and control the pressure of spraying compressed air. There are available some spray guns in which the spraying air pressure can be checked by the user operating the spray gun.

In the spray coating, both the quality of the finished coating and scattering of the paint mist greatly depend upon the spraying air pressure used in the air spray gun to spray paint on an object. Namely, it is well known that a higher air pressure will provide an increased energy for spraying and a finer atomization of the paint, which has generally contributed to an improved quality of paint coating. However, fine atomized mist of a paint is easily influenced by air flow to be more scattered. On this account, it is advisable to use a spray gun with an appropriate spraying pressure selected in accordance with the paint, object to be coated and coating conditions. For a quality spray coating, the spray gun should desirably be operated while monitoring the air pressure used for the spraying and under well-controlled conditions. In the recent spray guns, a lower air pressure is used to prevent the spray of paint from scattering, and thus because even a small change of the air pressure has a great influence on the coating quality, it has become more important to control the spraying air pressure.

Conventionally, the spraying air pressure is adjusted by a reducing valve or the like, and supplied through an air hose to the spray gun. During spraying of a paint, the user of the spray gun rarely checks the pressure of the air pressure. Recently, however, more and more air spray guns use a lower air pressure, and thus it has become important to adjust the air pressure within a lower pressure range and check the air pressure at hand.

Further, to assure a stable quality of painting and a quality skimming-coating of information devices and precision devices with a reduced amount of paint, it has become essential to appropriately control the paint spraying conditions.

Normally in the spray-coating tests, a spray gun is used with a pressure gauge being attached directly to the spray gun. In such tests, a general-purpose pressure gauge is connected to an air hose of the spray gun. However, the pressure gauge is rarely used in actual spray-coating because its weight and size are not acceptable in the routine paint spraying jobs.

It has been proposed to use a small pressure gauge installable directly to a spray gun and which permits the user of the spray gun to check the air pressure at any time in spraying a paint and will not interfere with the operation of the spray gun itself (cf. Japanese Published Examined Utility Model No. 22277 of 1993). This pressure gauge is an analog-indication one of a so-called Bourdon tube type. However, since the pressure gauge has to be designed smaller for installation to a spray gun which is normally not so large, such a pressure gauge is not satisfactory with respect to accuracy and durability in the operating environments.

Also, a spray gun with a digital-indication gauge using a pressure sensor is known from the disclosure in the Japanese Published Unexamined Utility Model No. 506310 of 1993. In this pressure gauge, a pressure gauge unit is housed in a closed container. When the service life of the driving cell has expired, the pressure gauge itself has to be discarded and replaced with a fresh one, which will lead to wasting of resources and addition of wastes.

The digital pressure gauge detects a pressure in an air channel and indicates it digitally, and this technology is already used in the general-purpose digital pressure gauge. The general-purpose digital pressure gauge includes a compressed air intake, pressure sensor, digital converter, indicator and a power unit, and it is used as an accessory to a spray gun. However, the pressure gauge thus used on the spray gun will add to the size and weight of the spray gun, which will cause increased fatigue of the user of the spray gun and will adversely affect the operability of the spray gun itself.

SUMMARY OF THE INVENTION

Accordingly, the present invention has an object to overcome the above-mentioned drawbacks of the related art by providing a spray gun usable with an accurate, easy-to-view pressure gauge which allows a spray coating of a stable and high quality, and can eliminate poor coating, minimize the paint consumption and prevent environmental pollution.

It is required that the pressure gauge used with the spray gun should be able to provide a stable pressure indication, have a long service life, be usable without any adverse influence on the shape and operability of the existent spray gun and permit the user to simply check an air pressure used in the spray gun.

The above-mentioned pressure gauge should preferably be an accurate, easy-to-view digital pressure gauge. However, this type of pressure gauge needs electric power, and thus it is important that a cell, which will be used as the power source, is replaceable taking account of the cell consumption.

Further, the cell should be safe enough so as not to cause any fire while spraying a paint diluted with a volatile solvent. Therefore, the cell should have an appropriate structure for use in a spray gun. Also it is a problem to solve by the present invention that to prevent a possible danger, the pressure gauge should easily be removable from the spray gun when no pressure indication is required for the spray gun.

Also, the spray gun once operated for spraying a paint has to be cleaned after use. Electronic parts used with the cell as the power source in the pressure gauge have to be protected against any affection caused by cleaning with a solvent. The above and other problems are solved by the present invention as will be described below.

According to the present invention, there is provided a spray gun including a spray gun body which atomizes a paint for spraying an object, and a pressure indication unit formed as at least a part of a grip of the spray gun to be removably installable on the spray gun grip and having assembled therein a pressure indication module including a pressure sensor, converter which is supplied with a detection signal from the pressure sensor and converts the signal into a digital signal, and a digital indicator to provide a digital indication of the digital signal output from the converter. Thus, an air intake can be provided independently of the spray gun body, and the pressure indication unit can be assembled to the spray gun body whenever necessary to accurately check a spraying air pressure on the spray gun body itself.

The pressure indication unit is formed integrally so as to form a pressure indication module, compressed air coupling and a portion for coupling to the spray gun body. Namely, the pressure indicator for indicating the pressure of compressed air introduced into the spray gun is designed as a unit. Thus, the pressure indication unit has an improved operability, can be produced separately from the spray gun body, can be assembled to the spray gun body as necessary to check the pressure of compressed air, and also can be used with another spray gun. That is, the pressure indication unit according to the present invention is highly versatile. More specifically, the pressure indication unit has the coupling portion at which it is installed on the spray gun body. Just attaching the pressure indication unit to the spray gun body will provide a spray gun which has a pressure indicator including the compressed air coupling connectable to a compressed air source.

The pressure indication module according to the present invention incorporates a digital converter which converts a pressure detection signal from a pressure sensor exposed in a compressed air channel into an electrical signal, and a pressure indicator which is supplied with the electrical signal output from the digital converter and digitally indicates the supplied electrical signal. Because of the integral forming of the main parts of the pressure indication module, the latter is designed sufficiently small to be incorporated in a pressure indication unit which will form a part of the spray gun grip. Thus the pressure indication unit can simply be attached to the spray gun which can thus permit the user to check the pressure of spraying air pressure easily and readily at hand.

Further, according to the present invention, there is provided a spray gun with a pressure indication module composed of a pressure sensor, digital converter and an indicator, formed integrally with each other. The pressure indication module has power terminals and a pressure-sensitive element of the pressure sensor exposed in the compressed air channel, the power terminals and pressure-sensitive element being exposed to the outside. Thus, the pressure indication module can easily be assembled to a device such as a spray gun and also assembled into the aforementioned pressure indication unit. It can maintain its stable performance and is connectable to a power source, which is provided separately.

Since the air gun is to spray a paint, and thus is always subject to adhesion of the paint, it is to be cleaned with a thinner and always exposed to an atmosphere of organic solvent. Also, the power unit and pressure indication module have to be airtight, especially at a portion where the electrical parts are provided, and therefore the electrical parts are isolated with a sealing material from outside.

Also, according to the present invention, there is provided an air spray gun in which compressed air having the pressure thereof adjusted is introduced through a compressed air intake and the atomizing air jet is controlled, the spray gun including a pressure sensor exposed in a channel for the adjusted compressed air and a pressure indication unit provided separately from the pressure sensor which receives a pressure detection signal output from the pressure sensor and converts the input pressure detection signal into an electrical signal. With this air spray gun, it is possible to check the pressure of compressed air accurately when the spray gun is being used, control the pressure of the compressed air that is spraying a paint to an object, and quickly adjust the compressed air pressure, if not appropriate, by an air pressure control valve provided in the spray gun to attain a stable quality of the paint spray coating.

Namely, the spray gun is normally supplied with compressed air having the pressure thereof adjusted at a compressed air source as having previously been described. Therefore, the spray gun can be used with compressed air whose pressure has been stabilized to some extent, but such a stability of the compressed air is not always sufficient when the user has to check and elaborately control the compressed air pressure. That is, even if the compressed air pressure is varied at the compressed air source, the user of the spray gun according to the present invention can readily check the pressure while spraying a paint and appropriately adjust the air pressure at the spray gun itself without leaving his or her spraying position.

Since the pressure sensor included in the present invention is provided in the air channel inside the spray gun to detect the actual pressure of an adjusted air jet, the pressure indication unit can always provide an accurate indication of the compressed air pressure in the course of spraying a paint and hence the user of the spray gun can operate the air pressure control valve in response to a variation in air pressure at the compressed air source. Namely, the user can instantly correct the pressure to a correct one and modify the spray gain to maintain a stable paint spraying operation.

Also, according to the present invention, an air pressure detection signal can be taken as an external signal, and supplied to a control unit provided separately to automatically control the pressure of compressed air.

These and other objects, features and advantages of the present invention will become more apparent from the ensuing detailed description of the preferred embodiments of the present invention when taken in conjunction with the accompanying drawings.

DETAILED DESCRIPTION OF THE INVENTION

Figure 1:
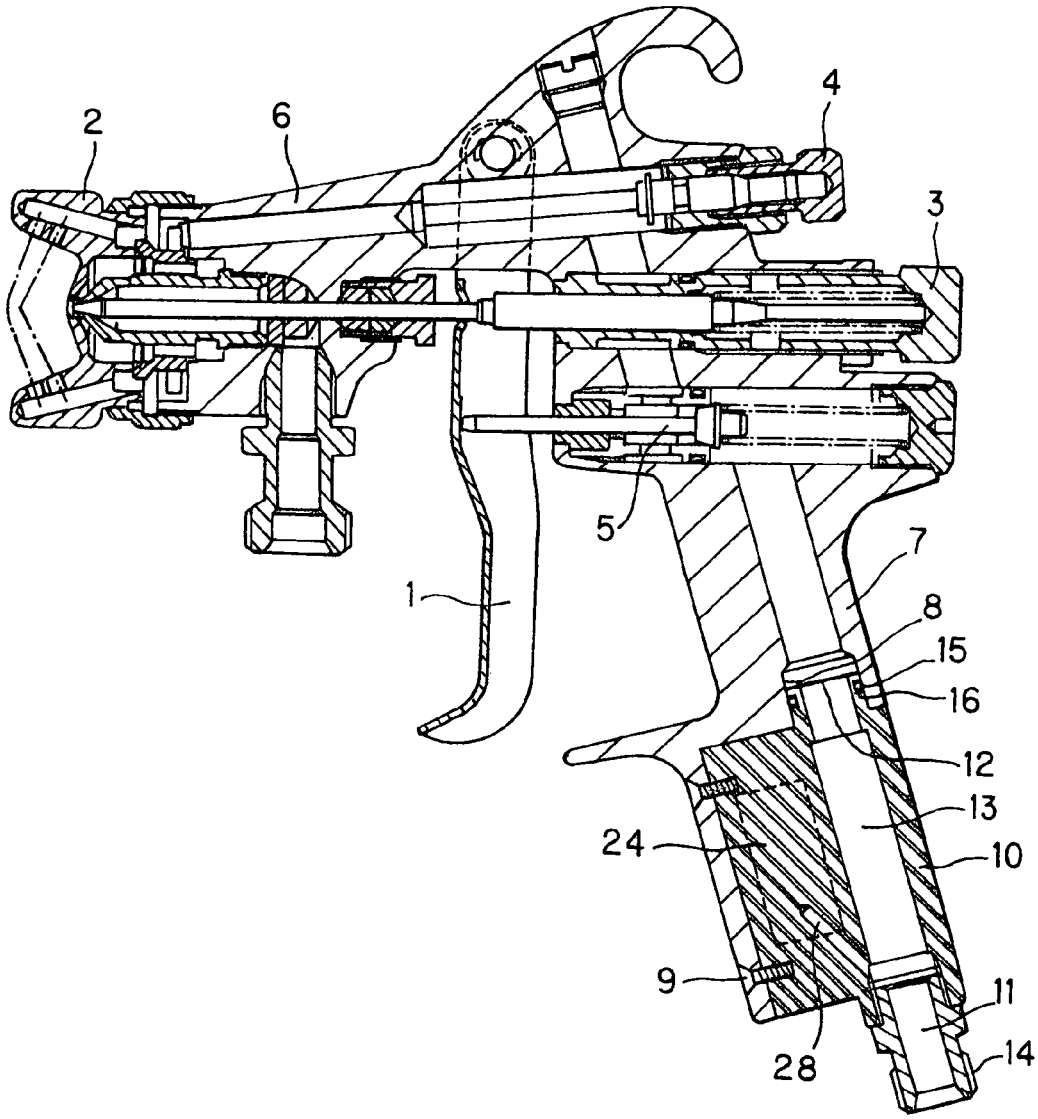
FIG. 1 is a schematic sectional view of the spray gun according an embodiment of the present invention.

Referring now to FIG. 1, there is schematically illustrated in the form of a sectional view the spray gun according to an embodiment of the present invention. The spray gun is of a manual type operated by a trigger 1. As shown, the spray gun includes a body and the spray gun body includes a gun barrel 6 having an atomization air cap 2, paint supply adjuster 3, spray pattern adjuster 4 and an air valve 5, and a grip 7 extending backward and downward from the gun barrel 6. A pressure indication unit 10 is removably fixed to the lower end of the grip 7, and thus forms a part of the grip 7.

The pressure indication unit 10 has a compressed air intake 11 formed at the lower end thereof. The compressed air intake 11 communicates with a central air channel 13 extending to a portion 12 for coupling to the spray gun body, formed at the upper end of the pressure indication unit 10. The pressure indication unit 10 is externally threaded (indicated at a reference 14) on the outer surface thereof inside which the compressed air intake 11 is formed. An air hose is fitted on the threads 14 and compressed air is introduced into the pressure indication unit 10 from a compressed air source. The coupling portion 12 is formed from a projecting cylinder 16 having a gasket 15 fitted on the outer surface thereof. The coupling portion 12 is inserted into a coupling hole 8 formed in the spray gun body 1 and directs compressed air from the compressed air intake 11 to the air valve 5.

The coupling portion 12 may be a projected portion of the spray gun body or simply a gasket, for example, which would be able to provide airtight channels in the coupling portion 12 and spray gun body 1. The pressure indication unit 10 is fixed with a screw 9 to the grip 7 after connecting the coupling unit 12 to the spray gun body 1 in an airtight manner. This fixation may of course be done otherwise.

Figure 2A:
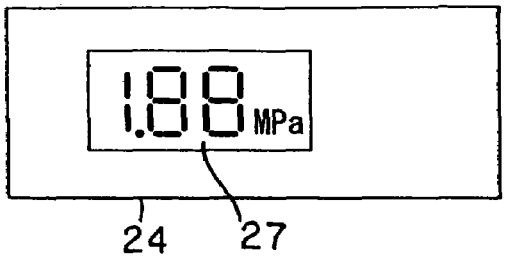
FIGS. 2(*a*) to 2(*c*) show the construction of one embodiment of a pressure transducer used in the present invention, in which FIG. 2 (*a*) is a plan view of the pressure transducer, FIG. 2 (*b*) is a side elevation of the pressure transducer, and FIG. 2 (*c*) is a rear view of the pressure transducer.
Figure 2B:
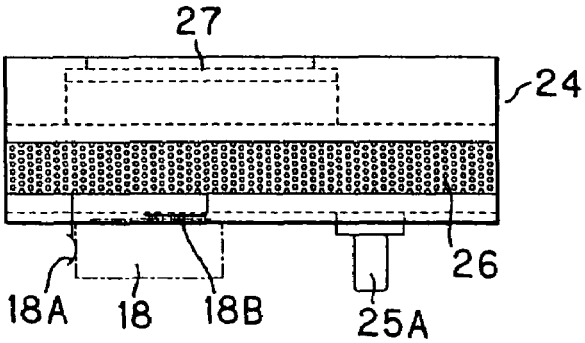
Figure 2C:
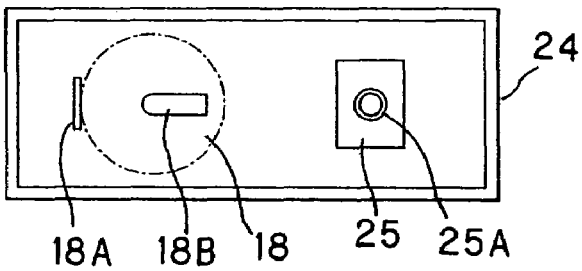
Figure 3:
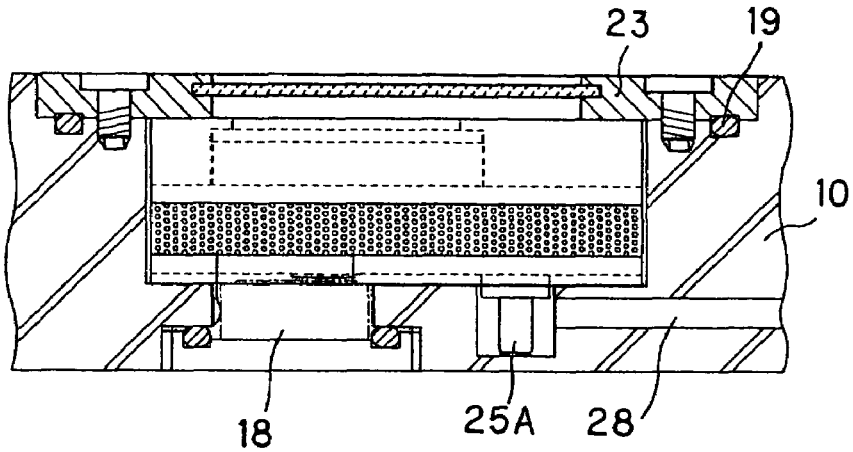
FIG. 3 is a partial sectional view of the pressure transducer set in a pressure indication unit.

The pressure indication unit 10 has built therein a pressure transducer 24 which is applied with the pressure of compressed air introduced through a branch channel 28 communicating with an air path 13 between the compressed air intake 11 and coupling portion 12. The pressure transducer 24 is illustrated in detail in FIG. 2. It is assembled in the pressure indication unit 10 as shown in FIG. 3. As will be apparent, the pressure transducer 24 includes a pressure sensor 25 having a part thereof exposed to the branch channel 28, a digital converter circuit board 26 which converts a displacement of the pressure sensor 25 into an electrical signal, and an indicator 27. These components of the pressure transducer 24 are formed integrally with each other.

The pressure transducer 24 includes an operation power unit 18. The power unit 18 has a button-shaped cell removably housed in a cell compartment. The power unit 18 is connected to power terminals 18A and 18B of the pressure transducer 24. The power unit 18 and indicator module are separately settable and removable. Thus, only the cell is a consumable part, and the cell can easily be replaced.

The pressure transducer 24 in which its elements are formed integrally with each other is fitted in a concavity formed in a part of the pressure indication unit 10 as shown in FIG. 3. A cover 23 is provided over the pressure transducer 24 with a gasket 19 placed under the cover 23. Thus the pressure transducer 24 is kept airtight. However, the pressure transducer 24 may be otherwise kept airtight correspondingly to its shape. Also, the power terminals 18A and 18B may be provided in places where they are connected directly to the cell. Although the places depend upon the location of the cell, the power terminals 18A and 18B may be connected indirectly to the cell each with each cord or connection piece.

A part of the pressure sensor 25 is exposed in the branch channel 28 communicating with the compressed air channel 13 to detect the pressure of supplied compressed air. The digital converter, formed as the circuit board 26, is electrically connected in a predetermined relative position to the indicator 27 formed from a liquid crystal panel. The pressure sensor 25, circuit board 26 and indicator 27 are desirably molded from an insulative resin as a pressure indication module held airtight while the power terminals 18A and 18B and a pressure-sensitive element 25A of the pressure sensor 25 are exposed to outside. Since the pressure indication module has thus an integrated structure as a small digital pressure gauge, it can provide a stable pressure indication and it is usable in any other device which requires a pressure indication, such as a hand-held device whose mass and size are limited.

The pressure transducer 24 converts a strain the pressure sensor 25 incurs when applied with a pressure into an electrical signal and displays the electrical signal as a digital indication signal on the indicator 27. It adopts the conventional digital conversion technology.

The pressure indication unit 10 is designed with consideration given to its appearance which should desirably fit the grip 7. When attached to the spray gun, it forms a part or all of the grip and thus adds a pressure indication function to the spray gun without spoiling the easy operability of the spray gun.

Figures 4A, 4B, 4C:
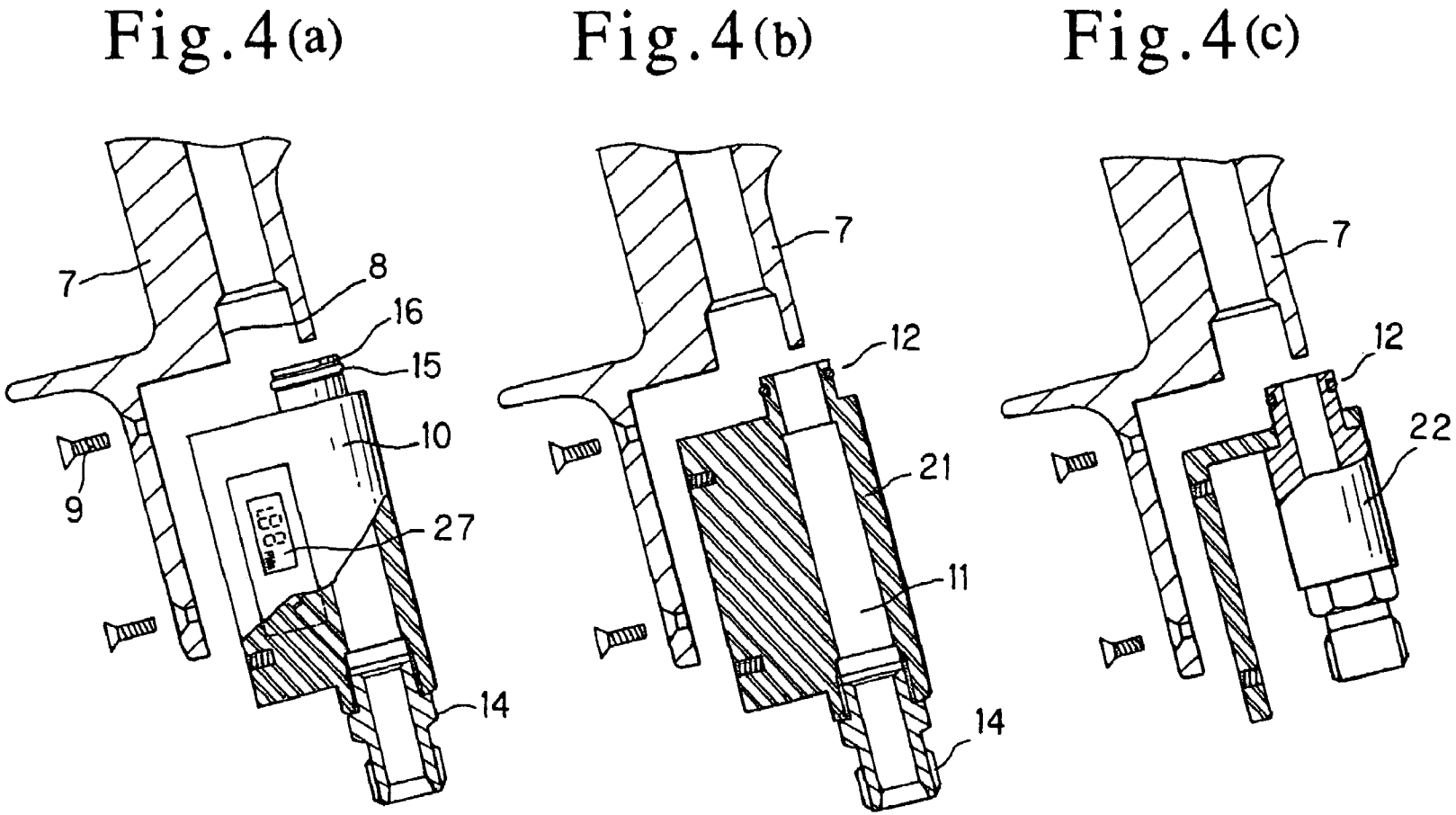
FIGS. 4(*a*) to 4(*c*) show the use of the spray gun according to the present invention, in which FIG. 4 (*a*) shows the grip of the spray gun to which the pressure indication unit according to the present invention is attached, FIG. 4 (*b*) shows the spray gun grip to which an adapter is attached, and FIG. 4 (*c*) shows the spray gun grip to which another adapter is attached.

FIG. 4 (*b*) shows a combination of the spray gun with an adapter 21 having the same appearance as the pressure indication unit 10 and provided with a compressed air intake and coupling portion. The adapter 21 is to be attached to the spray gun grip. FIG. 4 (*a*) shows a combination of the spray gun with the pressure indication unit 10 used in combination with the spray gun and shaped to fit the grip.

FIG. 4 (*c*) shows another adapter 22 incorporating an air supply adjusting means, which will permit a functional expansion of the spray gun.

With these adapters, the spray gun according to the present invention can be used as an ordinary one without any pressure indication. In case the paint spraying conditions are not so strict and the user of the spray gun can feel a change of air pressure and adjust the pressure, the spray gun may be used with any of these adapters. However, in case even a slight change in air pressure will adversely affect the finish of the painting, a paint should be sprayed under an ample pressure control or the air pressure has to be checked during spraying because the user cannot himself or herself judge the air pressure, the spray gun can be used with the pressure indication unit, which can be readily and easily replaced with any of the adapters.

Since the pressure indication unit incorporating electrical and electronic parts can be separated from other parts, the spray gun itself can advantageously be cleaned by washing in a thinner without any problem.

Figure 5:
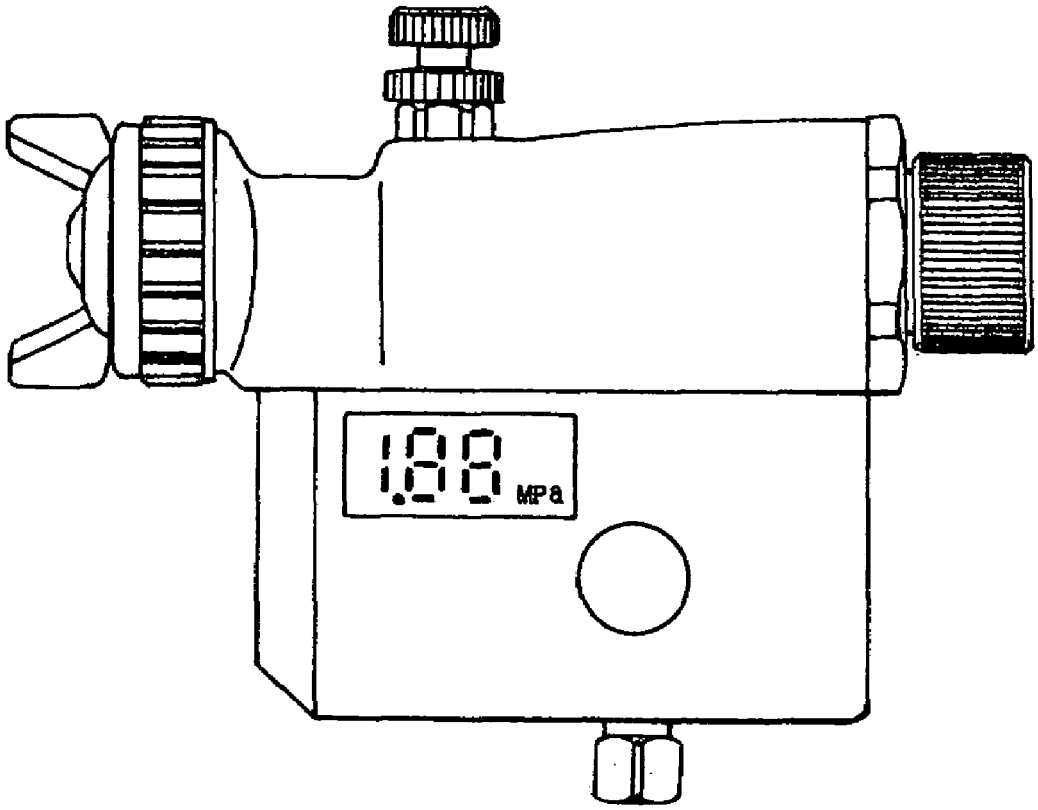
FIG. 5 is an external view of an automatic spray gun according to another embodiment of the present invention, in which a pressure indication unit is provided.

FIG. 5 shows an application of the present invention to an automatic spray gun in which paint spraying can automatically be controlled with an external signal. The automatic spray gun is supplied with compressed air under a pre-adjusted pressure. In the conventional automatic spray gun, however, the controller and spray gun are apart from each other and the pressure under which a desirable condition of spraying is maintained will vary depending upon the condition of the air-supply hose and operating conditions. Therefore the aforementioned problems cannot be solved by the conventional automatic spray gun. FIG. 5 shows another application of the pressure indication unit to such an automatic spray gun. It should be noted that the present invention is not limited to an automatic spray gun having any special structure.

As having been described in the foregoing, the present invention provides the pressure indication unit which accurately detects and indicates a spraying air pressure as an important factor in using the spray gun and can be installed easily and readily to the spray gun when necessary. The pressure indication unit allows the user of the spray gun to easily check and control the spraying air pressure. This effect of the pressure indication unit according to the present invention can be applied to the ordinary spray gun as well as the automatic spray gun.

Namely, since the pressure indication unit is designed as a removable module having necessary functions integrated therein, it can be attached to the spray gun when necessary to check and control the spraying air pressure. When no pressure indication is required, any of the adapters having no such function may be installed in place of the pressure indication unit, which will lead to saving of any extra costs and to a reasonable use of the spray gun.

Also, the pressure indication unit according to the present invention is designed to form a part of the grip of the manual spray gun, and it adds no excessive part to the spray gun. It allows the user of the spray gun to always check the spraying air pressure and thus prevent any defect in a painted surface or nonuniform coating due to any unexpected pressure change.

More specifically, the pressure indication unit according to the present invention is superior in accuracy, reliability and durability to the conventional analog pressure gauge. It assures an accurate checking of a spraying air pressure which has been just a measure of the painting quality, and permits a user to apply a spray coating under a relatively low pressure and strictly control spraying conditions for a quality paint coating.

The present invention provides a spray gun to which a module including an easy-to-view, accurate digital pressure gauge can be assembled. The accuracy and easy viewing of the pressure gauge assure a stable spraying operation for a quality coating, which will result in the elimination of poor coating, reduction of paint consumption and prevention of environmental pollution.

The invention claimed is:

1. A spray gun for atomizing and spraying paint, the spray gun comprising:

a spray gun body having a coupling hole;

a pressure indication unit detachably connected to the spray gun body, said pressure indication unit defining an air inlet, an air outlet, and a fluid channel extending between the air inlet and the air outlet, wherein the air outlet is coupled to the coupling hole of the spray gun body, and wherein the pressure indication unit forms most of a spray gun grip and is detachable from the spray gun body as a one piece unit; and a pressure transducer assembled in the pressure indication unit, the pressure transducer including a pressure sensor communicated with the fluid channel via an air passage formed in the pressure indication unit, a digital converter for converting a pressure detected by the pressure sensor into an electrical signal, and a digital indicator for providing a digital indication of an output electrical signal from the digital converter, wherein, a portion of the grip is integrally formed with the spray gun body and serves as a mounting bracket for the pressure indication unit.

2. The spray gun according to claim 1, wherein:

the digital converter comprises a circuit board, and the pressure sensor comprises a pressure sensitive element that is exposed to the fluid channel via the air passage;

the pressure sensor, the circuit board and the pressure indicator are integrally connected so as to form a pressure indication module;

the pressure indication module includes power terminals connected to the circuit board; and the pressure indication module is formed by molding an insulative resin such that only the power terminals and the pressure sensitive element are exposed outside of the pressure indication module.

3. The spray gun according to claim 2, wherein the pressure transducer includes a power unit connected to the power terminals, and the pressure transducer is isolated from outside of the spray gun by a sealing means.

4. The spray gun according to claim 1, wherein the pressure transducer includes a power unit and the pressure transducer is isolated from outside of the spray gun by a sealing means.

5. The spray gun according to claim 1, wherein the pressure indication unit is capable of being detached from the spray gun body to permit attachment of an adapter that forms at least part of the grip.

6. The spray gun according to claim 1, wherein the pressure indication unit is mechanically fastened to the portion of the grip that is formed with the spray gun body.

* * * * *